US008427304B2

(12) United States Patent
Wike

(10) Patent No.: US 8,427,304 B2
(45) Date of Patent: Apr. 23, 2013

(54) PROXIMITY SYSTEM FOR PORTABLE ELECTRONIC DEVICES AND ASSOCIATED METHODS FOR OPERATING THE SAME

(75) Inventor: Andy Wike, Lakeland, FL (US)

(73) Assignee: Andy Wike, Lakeland, FL (US)

( * ) Notice: Subject to any disclaimer, the term of this patent is extended or adjusted under 35 U.S.C. 154(b) by 750 days.

(21) Appl. No.: 12/434,893

(22) Filed: May 4, 2009

(65) Prior Publication Data

US 2009/0273485 A1 Nov. 5, 2009

Related U.S. Application Data

(60) Provisional application No. 61/050,466, filed on May 5, 2008.

(51) Int. Cl.
*G08B 1/08* (2006.01)

(52) U.S. Cl.
USPC ..... 340/539.13; 340/539.1; 340/531; 340/539.11

(58) Field of Classification Search ..... 340/539.13
See application file for complete search history.

(56) References Cited

U.S. PATENT DOCUMENTS

| | | | | |
|---|---|---|---|---|
| 5,801,627 | A | 9/1998 | Hartung | 340/568 |
| 6,320,503 | B1 | 11/2001 | Dunn et al. | 340/539 |
| 7,274,292 | B2 | 9/2007 | Velhal et al. | 340/539.32 |
| 7,327,255 | B2 | 2/2008 | Kassiedass | 340/568.1 |
| 2003/0043037 | A1 * | 3/2003 | Lay | 340/568.1 |
| 2004/0155777 | A1 * | 8/2004 | Mitchell et al. | 340/568.1 |
| 2005/0046580 | A1 * | 3/2005 | Miranda-Knapp et al. | 340/686.1 |
| 2006/0022822 | A1 * | 2/2006 | Wong et al. | 340/568.1 |
| 2006/0202840 | A1 * | 9/2006 | Korbonski | 340/573.4 |
| 2007/0290846 | A1 | 12/2007 | Schilling et al. | 340/572.1 |
| 2009/0179752 | A1 * | 7/2009 | Patel et al. | 340/539.13 |

* cited by examiner

*Primary Examiner* — Kerri McNally
(74) *Attorney, Agent, or Firm* — Allen, Dyer, Doppelt, Milbrath & Gilchrist, P.A

(57) ABSTRACT

A proximity system for a portable electronic device includes a base unit including a first proximity module, and a locator unit carried by the portable electronic device. The locator unit includes a controller, and a motion sensor coupled to the controller for determining if the portable electronic device is in motion. A second proximity module is coupled to the controller and is configured to cooperate with the first proximity module for determining if the portable electronic device is within a predetermined range of the base unit. The controller activates a return-to-base indicator if the portable electronic device is not in motion and is not positioned within the predetermined range of the base unit.

28 Claims, 4 Drawing Sheets

PROXIMITY SYSTEM FOR PORTABLE ELECTRONIC DEVICES AND ASSOCIATED METHODS FOR OPERATING THE SAME

RELATED APPLICATION

This application claims the benefit of U.S. Provisional Application Ser. No. 61/050,466 filed May 5, 2008, the entire contents of which are incorporated herein by reference.

FIELD OF THE INVENTION

The present invention relates to proximity systems for notifying users to return portable electronic devices to their intended resting locations when not in use. More particularly, the portable electronic devices include remote controls and cordless telephones, for example. For illustration purposes, the description will focus on remote controls.

BACKGROUND OF THE INVENTION

Remote controls are used to remotely control a variety of electronic devices, including televisions, stereos and DVD players, for example. Each remote control typically operates within line of sight of its respective electronic device. Many times, a user carries the remote control into another room, and momentarily puts it down only to walk away without the remote control in hand. This becomes an annoyance when the user, or even a different user, is later looking for the remote control in the room where the control should be located. Consequently, when a remote control is not in user it needs to be returned to a resting location near the electronic device that it controls.

One approach for locating a remote control is disclosed in U.S. Pat. No. 6,320,503. This patent is directed to a paging and organizing assembly for remote controls. A remote housing base is attached to a remote control, and includes a vibration circuit and a speaker. If the remote control is not stored in a remote control storage slot in a base unit, and cannot be found, the user pushes a transmitter button on the base unit. This causes a paging signal to be transmitted to the remote housing base. Upon receiving the paging signal, the remote housing base alerts the user to where the remote control is located.

Another approach is disclosed in U.S. Pat. No. 5,801,627. A transmit unit is affixed to a portable electronic device, and a receiver-alarm unit is positioned in a designated area. The receiver-alarm unit receives and processes signals transmitted by the transmit unit. When a level of the signals fall below a threshold, indicating that the transmit unit and the receiver alarm unit are an unacceptable distance apart, a threshold detector in the receiver alarm unit triggers an alarm to notify the user.

Even in view of the above-described approaches, there is still a need to improve how a user can be proactively notified to return a remote control when not in use to a resting location near the electronic device that it controls.

SUMMARY OF THE INVENTION

In view of the foregoing background, an object of the present invention is to provide a relatively straightforward proximity system for proactively notifying a user to return a portable electronic device to its intended resting location when not in use.

This and other objects, advantages and features in accordance with the present invention are provided by a proximity system for a portable electronic device comprising a base unit comprising a first proximity module configured to operate within a predetermined range of the base unit, and a locator unit carried by the portable electronic device.

The locator unit may comprise a controller, a motion sensor coupled to the controller for determining if the portable electronic device is in motion, and a second proximity module coupled to the controller and configured to cooperate with the first proximity module for determining if the portable electronic device is within the predetermined range of the base unit. A return-to-base indicator may be coupled to the controller. The controller may be configured to proactively activate the return-to-base indicator (without requiring an action by the user) if the portable electronic device is not in motion, and the portable electronic device is not positioned within the predetermined range of the base unit. The portable electronic device may be a remote control or a cordless telephone, for example.

The first and second proximity modules may cooperate based on RE signals for determining if the portable electronic device is within the predetermined range of the base unit. The RF signals may be coded so that the first proximity module in the base unit cooperates with at least one other second proximity module in a different locator unit.

The first proximity module may comprise a transmitter for transmitting the RE signals. The second proximity module may comprise a receiver for receiving the RF signals, and a measuring device for measuring the received RE signals and comparing the measured RF signals to a proximity threshold for determining if the portable electronic device is within the predetermined range of the base unit. Alternatively, the first and second proximity modules may cooperate based on at least one of infrared signals, inductive/capacitive coupling or sound waves.

The return-to-base indicator may comprise at least one of an audible indicator and a visual indicator. Alternatively, the return-to-base indicator may comprise both the audible indicator and the visual indicator, and a user selects which indicator is to be activated by the controller.

The locator unit may further comprise a timer for deactivating the return-to-base indicator when active if after a notification period the portable electronic device is still not in motion, or the portable electronic device is still not positioned within the predetermined range of the base unit. After a timeout period, the controller may reactivate the return-to-base indicator for another notification period if the portable electronic device is still not in motion, or the portable electronic device is still not positioned within the predetermined range of the base unit. The predetermined range of the base unit may be within about 4 feet, for example. The locator unit may further comprise a timer with a user input for deactivating the return-to-base indicator for a do-not-disturb period.

Another aspect of the present invention is directed to a method for operating a proximity system for a portable electronic device as described above. The method may comprise operating the first proximity module within the base unit, operating the motion sensor within the locator unit for determining if the portable electronic device is in motion, and operating the second proximity module within the locator unit to cooperate with the first proximity module for determining if the portable electronic device is within a predetermined range of the base unit. The method may further comprise operating the controller to activate the return-to-base indicator if the portable electronic device is not in motion, and the portable electronic device is not positioned within the predetermined range of the base unit.

DETAILED DESCRIPTION OF THE PREFERRED EMBODIMENTS

Figure 1:
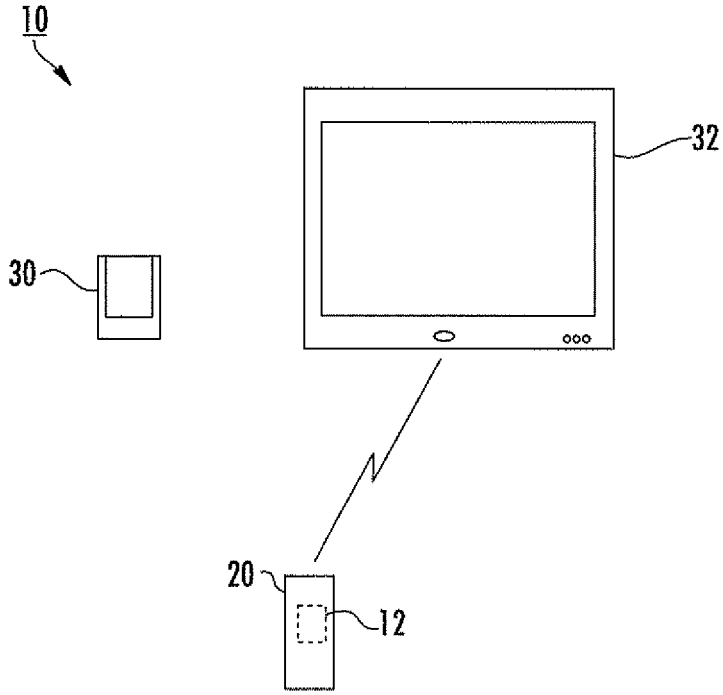
FIG. 1 is a block diagram of a proximity system for a remote control used to control an electronic device in accordance with the present invention.
Figure 2:
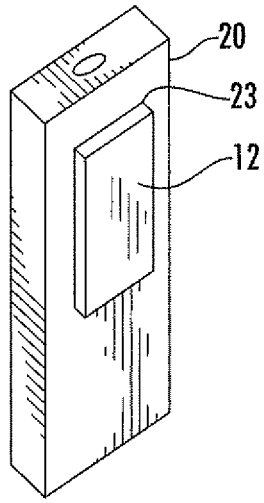
FIG. 2 is a perspective view of the remote control shown in FIG. 1 with a locator unit attached to the backside thereof.
Figure 3:
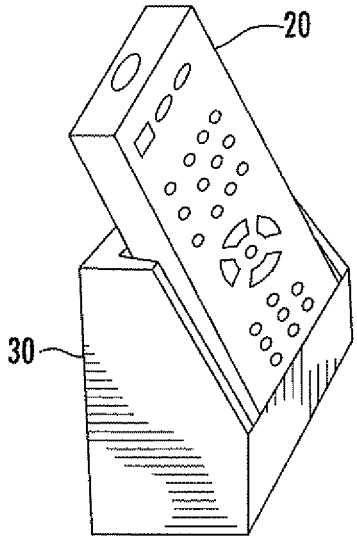
FIG. 3 is a perspective view of the base unit shown in FIG. 1 storing the remote control.
Figure 4:
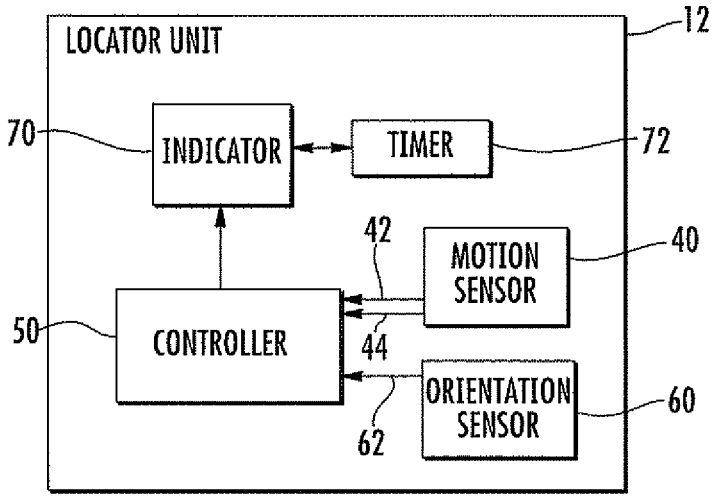
FIG. 4 is a block diagram of the locator unit shown in FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring initially to FIGS. 1-4, a first embodiment of a proximity system 10 will be discussed. This embodiment is based on the use of a motion sensor and an inclinometer, which is also referred to herein as an orientation sensor. The proximity system 10 comprises a locator unit 12 carried by a remote control 20, and a base unit 30 for storing the remote control when the remote control is not in use. If the remote control 20 is away from the base unit 30, and not in use, then the proximity system 10 proactively notifies the user that the remote control 20 is to be returned to the base unit 30. This notification is advantageously performed without requiring any action by the user.

The illustrated remote control 20 is for controlling an electronic device, such as a television 32, for example. The illustrated locator unit 12 is attached to the backside of the remote control 20 using an adhesive layer 23. In lieu of an adhesive layer 23, other methods may be used for attaching the locator unit 12 to the remote control 20. For example, hook-and-loop fasteners (i.e., velcro) may be used. Alternatively, the locator unit 12 may be internal to the remote control 20.

The electronic device is not limited to televisions. The electronic device may include devices such as stereos, DVD players and video game units. Any controller that remotely controls an electronic device is applicable to the proximity system 10, as readily appreciated by those skilled in the art. Moreover, the proximity system 10 is also applicable to other portable electronic and non-electronic devices that should be returned to their intended resting location when not in use.

The locator unit 20 includes a motion sensor 40 to determine if the remote control 20 is being moved. If there is movement, the motion sensor 40 sends a movement signal over path 42 that interfaces with a controller 50. The controller 50 interprets the movement signal to mean that the remote control 20 is in use. If the remote control 20 is stationary, the motion sensor 40 sends a no movement signal over path 44 that also interfaces with the controller 50. Even though separate paths 42, 44 are illustrated between the motion sensor 40 and the controller 50, the signals may be sent over a shared signal path.

After the controller 50 receives the no movement signal, a determination is made as to whether or not the remote control 20 has been returned to the base unit 30. An orientation sensor 60 may be used to make this determination. If the remote control 20 is in a near vertical position, this would indicate that it has been placed back at the base unit 30. In contrast, if the remote control 20 is in a near horizontal position, this would indicate that it has not been returned to the base unit 30.

The orientation sensor 60 may be separate from the motion sensor 40, or the two may be integrated as a single sensor. In the illustrated embodiment, the orientation sensor 60 is separate from the motion sensor 40. The orientation sensor 60 acts as a position sensitive switch that is normally open when horizontal, and normally closed when vertical. The transition between the open and closed positions of the orientation sensor 60 is known as the switch angle. Selection of the switch angle depends on the stored positioned of the remote control 20 at the base unit 30. Moreover, the function of the open and closed positions of the switch may be reversed.

The switch angle may be set at 45 degrees, for example. The controller 50 monitors the output of the orientation sensor 60 via path 62. If the controller 50 determines that the output from the orientation sensor 60 is in a closed state, meaning that the remote control 20 is orientated at an angle greater than 45 degrees, then the controller assumes that the remote control 20 is back at the base unit 30.

If the controller 50 determines that the output from the orientation sensor 60 is in an open state, meaning that the remote control 20 is orientated at an angle less than 45 degrees, then the controller assumes that the remote control 20 is away from the base unit 30. The switch angle may be set at an angle other than 45 degrees, such as 15 degrees, for example.

The controller 50 activates a return-to-base indicator 70 when the remote control 20 is orientated at an angle less than 45 degrees. The return-to-base indicator 70 may be an audible and/or a visual indicator. In one embodiment, the user selects the desired type of indication.

A timer 72 may be coupled to the return-to-base indicator 70. In other embodiments, the timer 72 may be coupled to the controller 50, or the timer may be integrated within the controller. If the return-to-base indicator 70 remains active for a notification period, such as 2 to 3 minutes, for example, and has still not been used or returned to the base unit 30, then the timer 72 momentarily deactivates the return-to-base indicator 70 for a timeout period.

After the timeout period, the controller 50 reactivate the return-to-base indicator 70 for another notification period if the remote control 20 is still not in motion, or the remote control 20 is still not positioned within the predetermined range of the base unit 30. This process may continue until the remote control 20 is either in use or has been returned to the base unit 30. Alternatively, the process continues for a limited number of notification/timeout periods, such as 3, for example.

A second embodiment of the proximity system 10' will be discussed with reference to FIGS. 5-6. This embodiment is based on the use of proximity modules 80', 90'. The proximity system 10' comprises a locator unit 12' carried by the remote control 20, and a base/home unit 30'. With the base/home unit 30', the remote control 20' does not need to be stored therein when not in use. Consequently, the use of an orientation sensor 60 is not required in this embodiment. Instead, the remote control 20' needs to be returned near or in proximity to the base/home unit 30'. Nonetheless, if the base/home unit 30' is configured as a cradle to receive the remote control 20', then the orientation sensor would be used. The locator unit 12' comprises a first proximity module 80' that communicates with a second proximity module 90' at the base/home unit 30'. The communications range between the first and second proximity modules 80', 90' corresponds to a predefined proximity radius or range. The proximity radius may be defined to be 3 to 4 feet, for example. The first and second proximity modules 80', 90' may communicate based on radio frequency (RF) signals, infrared (IR)/optical signals, inductive/capacitive coupling, and sound waves, for example.

In the illustrated embodiment, the first proximity module 90' at the base/home unit 30' comprises a transmitter 92' for transmitting a proximity signal to the second proximity module 80' at the remote control 20'. The second proximity module 80' at the remote control 20' comprises a receiver 82' and a measurement device 84' coupled to the receiver. The measurement device 84' measures a level of the received proximity signal and provides the measured level to the controller 50'.

If the measured level of the proximity signal is greater than a threshold, then the remote control 20' is within the proximity radius of the base/home unit 30'. The controller 50' does not activate the return-to-base indicator 70' even if the remote control 20' is in a near horizontal position.

However, if the measured level of the proximity signal is less than the threshold, then the remote control 20' is considered to be outside the proximity radius of the base/home unit 30'. In this case, the controller 50' activates the return-to-base indicator 70' based on inputs from the motion sensor 40'. Alternatively, the measurement device 84' may compare the measured level of the proximity signal to the threshold and report the same to the controller 50'.

When the remote control 20' has been returned near the base/home unit 30, the first and second proximity modules 80', 90' do not need to communicate. However, the first and second proximity modules 80', 90' will start communicating when the motion sensor 40' detects movement of the remote control 20'.

As a design alternative, the function of the first and second proximity modules 80', 90' may be reversed. The proximity signal may be transmitted by the locator unit 12'. If the measured level of the proximity signal received by the base/home unit 30' is less than the threshold, then the first proximity module at the base/home unit 30' activates a return-to-base indicator coupled to its proximity module. Alternatively, the first proximity module at the base/home unit 30' transmits a higher powered status signal back to the second proximity module at the remote control 20' indicating that the remote control is outside the proximity range. This allows the controller 50' to activate the return-to-base indicator 70' at the remote control 20'.

If the user is watching a movie and wants the remote control 20' to remain away from the base/home unit 30', the user has an option of deactivating the return-to-base indicator 70' for a do-not-disturb period. The do-not-disturb period may be 1 hour, for example. Deactivation of the return-to-base indicator 70' may be accomplished using the timer 72'. The timer 72' may have a user-selected input for selecting the do-not-disturb period. Alternatively, the do-not-disturb period may be selected by shaking the remote control for a few seconds, for example, to deactivate the return-to-base indicator 70'.

The transmitter 92' at the base/home unit 30' can be used to support more than one remote control 20'. For example, the base/home unit 30' is adjacent a home theater system, and more than one remote control is used to control the home theater system. If necessary, the proximity signals may be coded so that each respective remote control can be individually identified.

Figure 5:
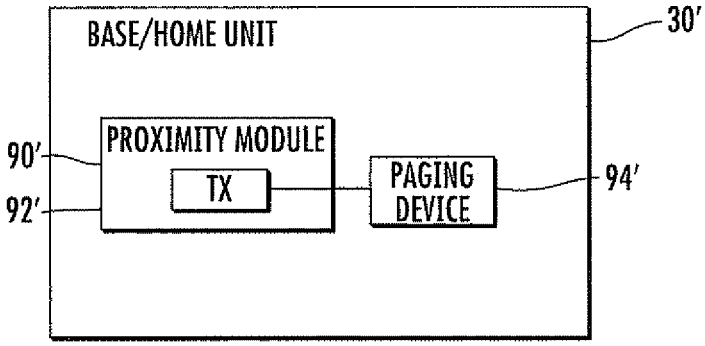
FIG. 5 is a block diagram of the base unit in accordance with another embodiment of the present invention.
Figure 6:
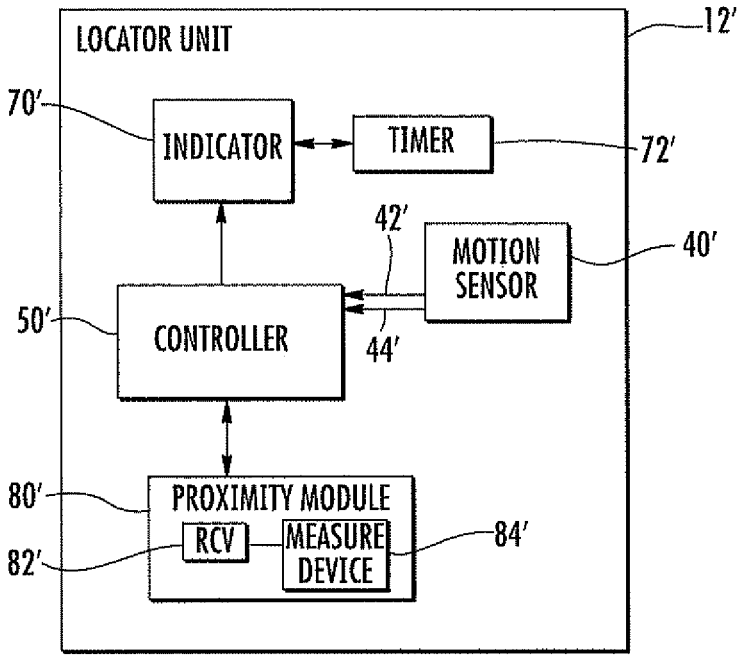
FIG. 6 is a block diagram of the locator unit in accordance with another embodiment of the present invention.

As also illustrated in FIG. 5, a paging device 94' is coupled to the transmitter 82'. When the user activates the paging device 94', such as by depressing a button, the return-to-base indicator 70' at the locator unit 12' is activated. This advantageously allows the user to locate the remote control 20' if it is away from the base/home unit 30'.

As noted above, the first and second proximity modules 80', 90' may operate based on inductive coupling instead of RF signals. The inductive coupling is similar to the way RFID tags operate. The first proximity module 90' at the base/home unit 30' includes a reader that generates a magnetic field. As readily appreciated by those skilled in the art, electrical current has an electrical component and a magnetic component. Because of this, the magnetic field can be created with electricity, and electrical current can be created with the magnetic field.

The magnetic field from the reader within the first proximity module 90' at the base/home unit 30' inducts a current in the second proximity module 80' at the remote control 20'. The controller 50' receives an input from the second proximity module 80' indicating that the remote control 20' is within the proximity radius of the base/home unit 30'. Alternatively, the function of the first and second proximity modules 80', 90' could be reversed so that the reader is in the remote control 20', as also readily appreciated by those skilled in the art.

The illustrated locator unit 12' is external to the remote control 20. Alternatively, the locator unit may be internal to the remote control 20'. The locator unit 12' is battery powered. It may operate on its own battery, or may share the same batteries used by the remote control 20'. The base/home unit 30' may be battery powered, or it may operate via an electrical outlet. In the first embodiment 10, the batteries in the locator unit 12 may be charged while docked with the base unit 30.

The illustrated proximity systems 10, 10' are applicable to all types of remote controls and other types of devices and objects, some of which are not electronic in nature. The proximity systems 10, 10' are also applicable to cordless telephones. Similar to remote controls, a user very often leaves a cordless telephone handset in a room different from that of the corresponding docking station.

The functions of the above-described storage unit 30 or base/home unit 30' would be integrated into the docking station for the cordless telephone. In addition, the off button on the cordless telephone could be used to determine if it is in use. This feature supplements or replaces the need for the motion sensor.

Figure 7:
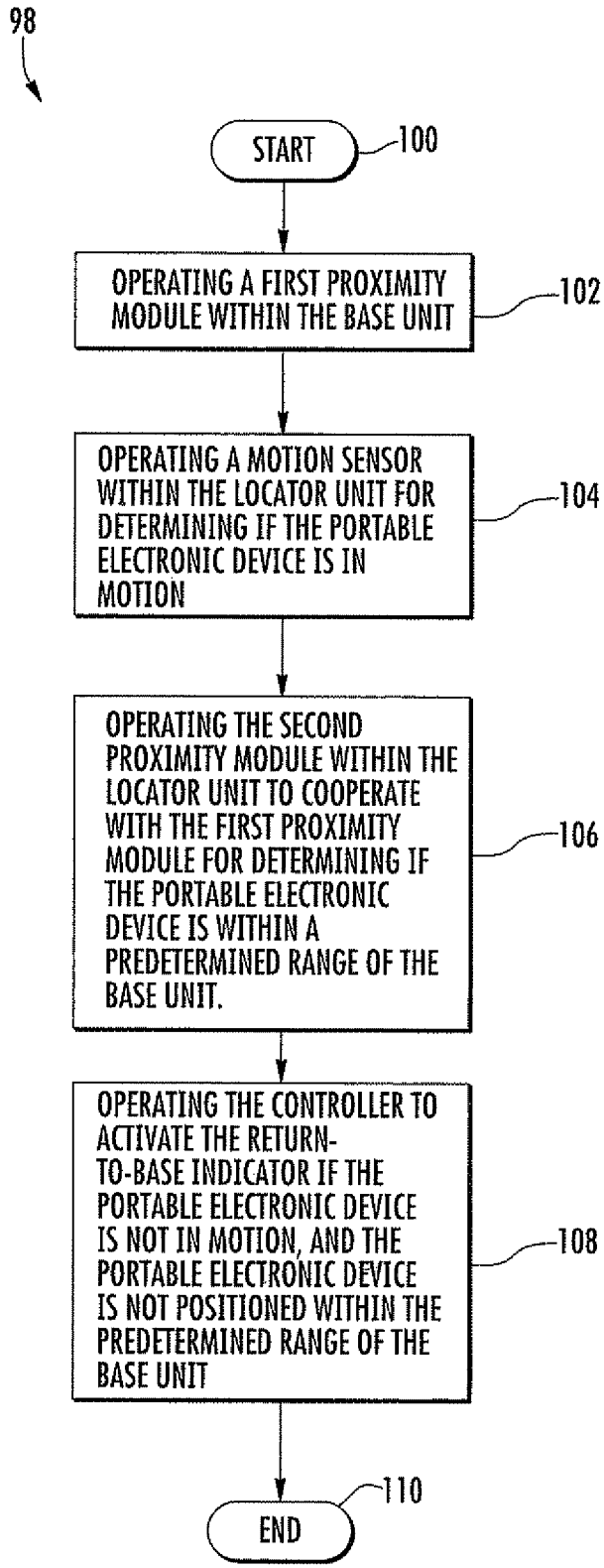
FIG. 7 is a flow chart for operating a proximity system in accordance with the present invention.

Referring now to FIG. 7, another aspect is directed to a method for operating a proximity system 10' for a remote control **20*r* as described above. From the start (Block 100) in the illustrated flow chart 98, the method comprises operating the first proximity module 90' within the base unit 30' at Block 102, operating the motion sensor 40' within the locator unit 12' for determining if the portable electronic device 20' is in motion at Block 104, and operating the second proximity module 90' within the locator unit 12' to cooperate with the first proximity module 80' for determining if the portable electronic device 20' is within a predetermined range of the base unit 30' at Block 106. The method further comprises at Block 108 operating the controller 50' to activate the return-to-base indicator 70' if the portable electronic device 20' is not in motion, and the portable electronic device 20' is not positioned within the predetermined range of the base unit 30' The method ends at Block 110**.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A proximity system for a portable electronic device comprising:

a base unit comprising a first proximity module configured to operate within a predetermined range of said base unit, said first proximity module comprising a transmitter; and a locator unit carried by the portable electronic device and comprising a controller, a motion sensor coupled to said controller for determining if the portable electronic device is being carried by a user indicating that the portable electronic device is in use while in motion, a second proximity module coupled to said controller and configured to cooperate with said first proximity module for determining if the portable electronic device is within the predetermined range of said base unit, said second proximity module comprising a receiver, and a return-to-base indicator coupled to said controller, said controller configured to activate said return-to-base indicator if the portable electronic device is not in motion, and the portable electronic device is not positioned within the predetermined range of said base unit;

said base unit being configured to hold the portable electronic device in a substantially vertical position when returned thereto; and said locator unit further comprising an orientation sensor cooperating with said motion sensor for determining if the portable electronic device is in the substantially vertical position or in a substantially horizontal position.

2. The proximity system according to claim 1 wherein said first and second proximity modules cooperate based on RF signals for determining if the portable electronic device is within the predetermined range of said base unit.

3. The proximity system according to claim 2 wherein the RF signals are coded so that the first proximity module in said base unit cooperates with at least one other second proximity module in a different locator unit.

4. The proximity system according to claim 2 wherein a measuring device measures a level of the received RF signals and compares the measured RF signal levels to a proximity threshold for determining if the portable electronic device is within the predetermined range of said base unit.

5. The proximity system according to claim 1 wherein said first and second proximity modules cooperate based on at least one of infrared signals, inductive/capacitive coupling and sound waves.

6. The proximity system according to claim 1 wherein said locator unit further comprises:

an enclosure for said controller, said motion sensor, said second proximity module and said return-to-base indicator; and an adhesive layer for attaching said enclosure to the portable electronic device.

7. The proximity system according to claim 1 wherein said return-to-base indicator comprises at least one of an audible indicator and a visual indicator.

8. The proximity system according to claim 7 wherein said return-to-base indicator comprises both said audible indicator and said visual indicator, and a user selects which indicator is to be activated by said controller.

9. The proximity system according to claim 1 wherein said locator unit further comprises a timer for deactivating said return-to-base indicator when active if after a notification period the portable electronic device is still not in motion, or the portable electronic device is still not positioned within the predetermined range of said base unit.

10. The proximity system according to claim 9 wherein after a timeout period, said controller reactivates said return-to-base indicator for another notification period if the portable electronic device is still not in motion, or the portable electronic device is still not positioned within the predetermined range of said base unit.

11. The proximity system according to claim 1 wherein said locator unit further comprises a timer with a user input for deactivating said return-to-base indicator for a do-not-disturb period.

12. The proximity system according to claim 1 wherein the predetermined range of said base unit is within about 4 feet.

13. The proximity system according to claim 1 wherein the portable electronic device is configured as at least one of a remote control and a cordless telephone.

14. A proximity system for a remote control comprising:

a base unit comprising a first RF module; and a locator unit carried by the remote control and comprising an enclosure, an adhesive layer for attaching said enclosure to the remote control, a controller within said enclosure, a motion sensor within said enclosure and coupled to said controller for determining if the remote control is in motion, a second RF module within said enclosure and coupled to said controller and configured to cooperate with said first RF module for determining if the remote control is within a predetermined range of said base unit, and a return-to-base indicator within said enclosure and coupled to said controller, said controller configured to activate said return-to-base indicator if the remote control is not in motion, and the remote control is not positioned within the predetermined range of said base unit.

15. The proximity system according to claim 14 wherein said first RF module comprises a transmitter for transmitting RF signals; and wherein said second RF module comprises a receiver for receiving the RF signals, and a measuring device that measures a level of the received RF signals and compares the measured RF signal levels to a proximity threshold for determining if the remote control is within the predetermined range of said base unit.

16. The proximity system according to claim 14 wherein said base unit is configured to hold a portable electronic device in a substantially vertical position when returned thereto; and wherein said locator unit further comprises an orientation sensor cooperating with said motion sensor for determining if the portable electronic device is in the substantially vertical position or in a substantially horizontal position.

17. The proximity system according to claim 14 wherein said return-to-base indicator comprises at least one of an audible indicator and a visual indicator; and wherein said locator unit further comprises a timer for deactivating said return-to-base indicator when active if after a notification period the remote control is still not in motion, or the remote control is still not positioned within the predetermined range of said base unit.

18. A method for operating a proximity system for a portable electronic device, the proximity system comprising a base unit comprising a first proximity module and a locator unit carried by the portable electronic device, the locator unit comprising a controller, a motion sensor coupled to the controller and a second proximity module coupled to the controller, the method comprising:

operating the first proximity module within the base unit, the first proximity module comprising a transmitter;

operating the motion sensor within the locator unit for determining if the portable electronic device is being carried by a user indicating that the portable electronic device is in use while in motion;

operating the second proximity module within the locator unit to cooperate with the first proximity module for determining if the portable electronic device is within a predetermined range of the base unit, the second proximity module comprising a receiver; and operating the controller to activate a return-to-base indicator if the portable electronic device is not in motion, and the portable electronic device is not positioned within the predetermined range of the base unit;

holding the portable electronic device in a substantially vertical position when returned to the base unit; and determining if the portable electronic device is in the substantially vertical position or in a substantially horizontal position based on the locator unit further comprising an orientation sensor cooperating with the motion sensor.

19. The method according to claim 18 wherein the first and second proximity modules cooperate based on RF signals for determining if the portable electronic device is within the predetermined range of the base unit.

20. The method according to claim 19 wherein a measuring device for measuring a level of the received RF signals and comparing the measured RF signal levels to a proximity threshold for determining if the portable electronic device is within the predetermined range of the base unit.

21. The method according to claim 18 wherein the locator unit further comprises an enclosure for the controller, the motion sensor, the second proximity module and the return-to-base indicator; and an adhesive layer for attaching the enclosure to the portable electronic device.

22. The method according to claim 18 wherein the return-to-base indicator comprises at least one of an audible indicator and a visual indicator.

23. The method according to claim 18 wherein the locator unit further comprises a timer for deactivating the return-to-base indicator when active if after a notification period the portable electronic device is still not in motion, or the portable electronic device is still not positioned within the predetermined range of the base unit.

24. The method according to claim 23 wherein after a timeout period, the controller reactivates the return-to-base indicator for another notification period if the portable electronic device is still not in motion, or the portable electronic device is still not positioned within the predetermined range of the base unit.

25. The method according to claim 18 wherein the portable electronic device is configured as at least one of a remote control and a cordless telephone.

26. A proximity system for a portable electronic device comprising:

a base unit comprising a first proximity module configured to operate within a predetermined range of said base unit, said first proximity module comprising a transmitter; and a locator unit carried by the portable electronic device and comprising a controller, a motion sensor coupled to said controller for determining if the portable electronic device is being carried by a user indicating that the portable electronic device is in use while in motion, a second proximity module coupled to said controller and configured to cooperate with said first proximity module for determining if the portable electronic device is within the predetermined range of said base unit, said second proximity module comprising a receiver, and a return-to-base indicator coupled to said controller, said controller configured to activate said return-to-base indicator if the portable electronic device is not in motion, and the portable electronic device is not positioned within the predetermined range of said base unit, and further comprising a timer for deactivating said return-to-base indicator when active if after a notification period the portable electronic device is still not in motion, or the portable electronic device is still not positioned within the predetermined range of said base unit.

27. The proximity system according to claim 26 wherein after a timeout period, said controller reactivates said return-to-base indicator for another notification period if the portable electronic device is still not in motion, or the portable electronic device is still not positioned within the predetermined range of said base unit.

28. A proximity system for a portable electronic device comprising:

a base unit comprising a first proximity module configured to operate within a predetermined range of said base unit, said first proximity module comprising a transmitter; and a locator unit carried by the portable electronic device and comprising a controller, a motion sensor coupled to said controller for determining if the portable electronic device is being carried by a user indicating that the portable electronic device is in use while in motion, a second proximity module coupled to said controller and configured to cooperate with said first proximity module for determining if the portable electronic device is within the predetermined range of said base unit, said second proximity module comprising a receiver, a return-to-base indicator coupled to said controller, said controller configured to activate said return-to-base indicator if the portable electronic device is not in motion, and the portable electronic device is not positioned within the predetermined range of said base unit, a timer with a user input for deactivating said return-to-base indicator for a do-not-disturb period.

* * * * *

UNITED STATES PATENT AND TRADEMARK OFFICE

CERTIFICATE OF CORRECTION

PATENT NO. : 8,427,304 B2
APPLICATION NO. : 12/434893
DATED : April 23, 2013
INVENTOR(S) : Wike It is certified that error appears in the above-identified patent and that said Letters Patent is hereby corrected as shown below:

In the Specification

| | |
|---|---|
| Column 2, Line 21 | Delete: "RE"<br>Insert: -- RF -- |
| Column 2, Line 27 | Delete: "RE"<br>Insert: -- RF -- |
| Column 2, Line 29 | Delete: "RE"<br>Insert: -- RF -- |
| Column 6, Line 10 | Delete: "94'"<br>Insert: -- 84' -- |
| Column 6, Line 56 | Delete: "20r"<br>Insert: -- 20' -- |

Signed and Sealed this
Twenty-fifth Day of June, 2013

Teresa Stanek Rea
*Acting Director of the United States Patent and Trademark Office*